US006648665B1

(12) United States Patent
Wu

(10) Patent No.: US 6,648,665 B1
(45) Date of Patent: Nov. 18, 2003

(54) ELECTRICAL CONNECTOR HAVING AN AUTOMATICALLY RECOVERABLE PULL TAB AND LATCHES

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/226,729

(22) Filed: Aug. 23, 2002

Related U.S. Application Data

(63) Continuation-in-part of application No. 10/210,129, filed on Jul. 31, 2002.

(51) Int. Cl.[7] ..... H01R 13/627
(52) U.S. Cl. ..... 439/352; 439/357
(58) Field of Search ..... 439/352, 357, 439/353, 358, 345, 350, 354, 355

(56) References Cited

U.S. PATENT DOCUMENTS 5,197,901 A * 3/1993 Hashiguchi ..... 439/352
5,234,357 A * 8/1993 Yamaguchi ..... 439/354
5,435,744 A * 7/1995 Derstine et al. ..... 439/352
5,564,939 A * 10/1996 Maitani et al. ..... 439/352
5,634,809 A * 6/1997 Hirai ..... 439/352
5,915,987 A * 6/1999 Reed et al. ..... 439/352
6,149,451 A * 11/2000 Weber ..... 439/358
6,280,227 B1 * 8/2001 Terada et al. ..... 439/357
6,319,040 B1 * 11/2001 Chang ..... 439/352
6,371,787 B1 * 4/2002 Branch et al. ..... 439/352
6,431,887 B1 * 8/2002 Yemans et al. ..... 439/108
6,485,315 B1 * 11/2002 Hwang ..... 439/108
6,589,066 B1 * 7/2003 Wu ..... 439/352

* cited by examiner

*Primary Examiner*—Alexander Gilman
(74) *Attorney, Agent, or Firm*—Wei Te Chung

(57) ABSTRACT

An electrical connector (1) includes a base (10) and a cover (20) assembled together. The base has a mating frame (13) formed on a front portion thereof. A connector subassembly (60) assembled into the mating frame. A pair of metal springs (90) mounted on the base. A pair of latches is mounted to opposite sides of the base and is deflectable in lateral direction. A pull tab (80) is assembled to the base and has a pair of latch releasing portions (83). The pull tab is movable in front-to-back direction which is perpendicular to the lateral direction. When the pull tab is pulled backwardly, the latch releasing portions push the latches to laterally deflect and the metal springs are elastically deformed. When the pull tab is released, the metal springs exerts a spring force on the pull tab to cause the pull tab and the latches return back to original positions.

9 Claims, 9 Drawing Sheets

ELECTRICAL CONNECTOR HAVING AN AUTOMATICALLY RECOVERABLE PULL TAB AND LATCHES

CROSS-REFERENCE TO RELATED APPLICATIONS

The present invention is a continuation-in-part (C-I-P) application of the patent application Ser. No. 10/210,129 entitled "ELECTRICAL CONNECTOR HAVING A LATCH MECHANISM", filed on Jul. 31, 2002, and assigned to the assignee of the present invention. The disclosure of the '129 patent application is incorporated herein by reference. Other two related applications of which one was filed Aug. 12, 2002, both have the same title, the same applicant, and the same assignee as the invention, being the references herewith, too.

BACKGROUND OF THE INVENTION

1. Field of the Invention

The present invention relates to an electrical connector, and particularly to an electrical connector having a pull tab and a pair of latches for engaging and releasing a mated complementary connector.

2. Description of Prior Art

U.S. Pat. No. 5,564,939, issued to Yukihiro Maitani et al on Oct. 15, 1996, discloses a conventional electrical connector having a pair of latch springs 22 and 22A respectively attached on opposite sides of a housing 21 of the connector. An operating member 23 has a pair of latch releasing cams 23-4 located below angled portions 22-4 of the latch springs 22, 22A. When an operator pulls a pull tab 23-8 of the operating member 23 backwardly, the latch releasing cams 23-4 exert outward forces on the angled portions 22-4 and U-shaped claws 22-1 slip out to release a mated complementary connector. Because the operating member 23 and the latch springs 22, 22A are positioned outside of the housing 21, they are very easy to be damaged when a force is exerted thereon. When two or more such connectors are arranged side by side, a relatively large space is needed between every two connectors and this adversely affects the compact design of an electronic system including such connectors. Furthermore, when the pulling force acting on the operating member 23 is released, the latch springs 22, 22A exert a force to push the operating member 23 to its original position. However, the force is too small to exactly pull the operating member 23 to the original position. To overcome the above mentioned disadvantages, an electrical connector is needed that a pull tab of the connector can automatically return to its original position.

SUMMARY OF THE INVENTION

It is an objective of the present invention to provide an electrical connector having a pull tab engaging with a pair of latches for latching and releasing a mated complementary connector; the pull tab and the latches can automatically resume to their original positions after they are motivated to release released the complementary connector from the electrical connector in accordance with the present invention.

In order to achieve the above-mentioned object, an electrical connector in accordance with the present invention comprises a base and a cover assembled together. The base has a mating frame formed on a front portion thereof. A connector subassembly is assembled to the base and has a portion extending into the mating frame. A pair of metal springs is mounted on the base. A pair of latches is mounted to opposite sides of the base and is deflectable in lateral direction. A pull tab is assembled to the base and has a pair of latch releasing portions. The pull tab is movable in front-to-back direction which is perpendicular to the lateral direction. When the pull tab is pulled backwardly, the latch releasing portions push the latches to laterally deflect and the metal springs are elastically deformed. When the pull tab is released, the metal springs exerts a spring force on the pull tab to cause the pull tab and the latches to return back to original position.

Other objects, advantages and novel features of the invention will become more apparent from the following detailed description when taken in conjunction with the accompanying drawings.

DETAILED DESCRIPTION OF THE INVENTION

Figure 1:
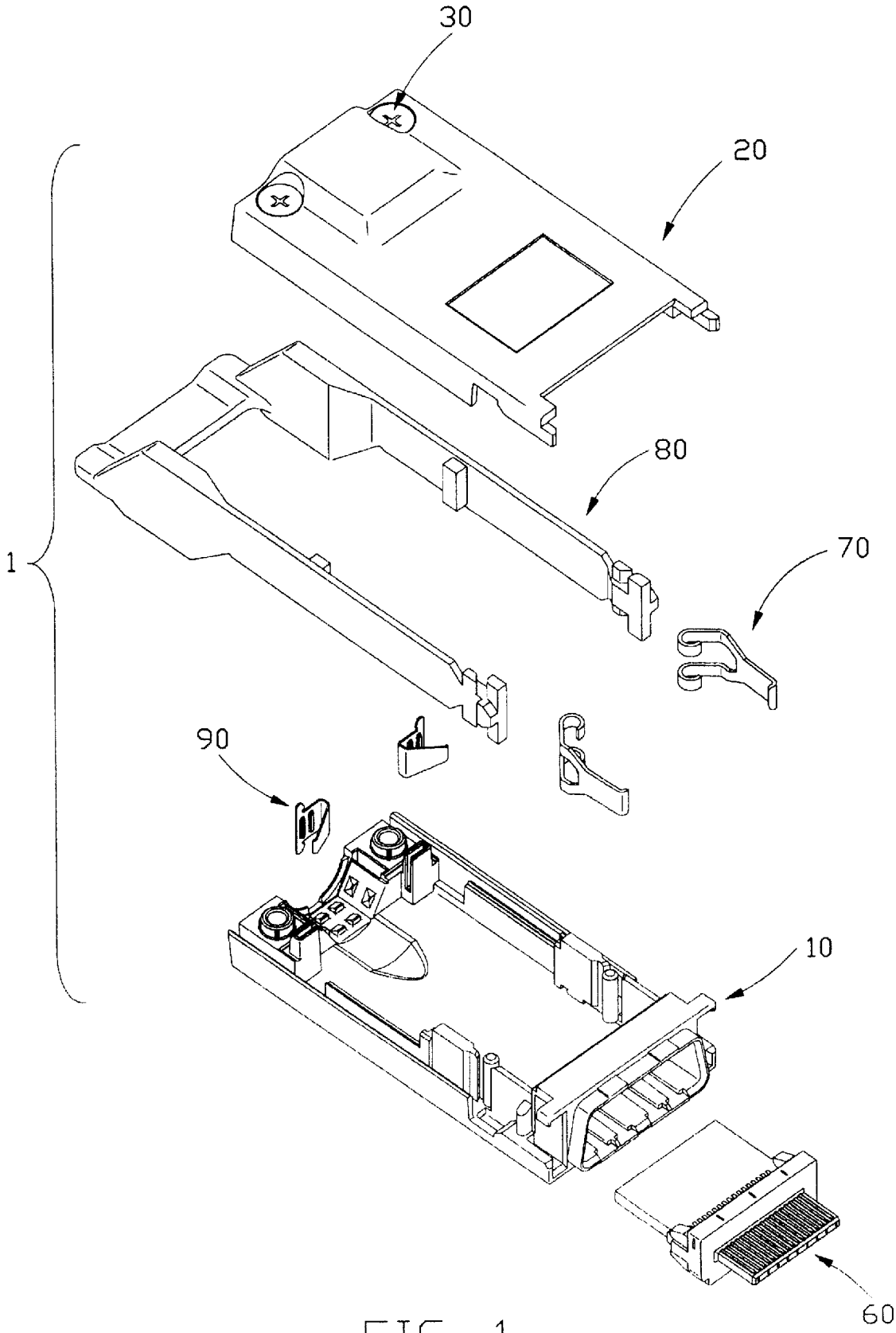
FIG. 1 is an exploded perspective view of an electrical connector in accordance with the present invention.

Referring to FIG. 1, an electrical connector 1 in accordance with the present invention comprises a base 10, a cover 20 for being assembled to the base 10, a pair of screws 30 for securing the cover 20 on the base 10, a connector subassembly 60, a pair of metal latches 70, a pull tab 80, and a pair of metal springs 90.

Figure 2:
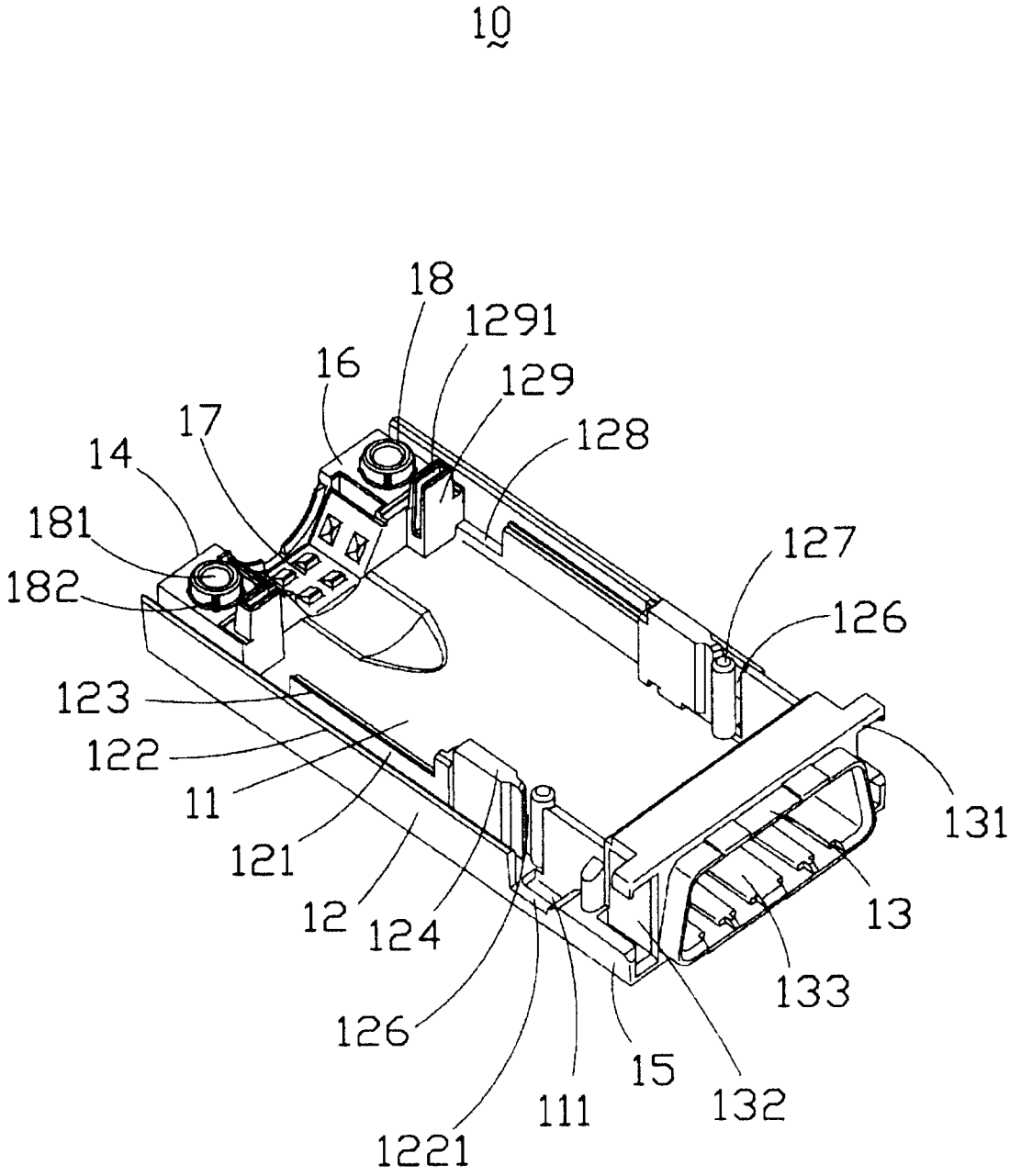
FIG. 2 is a perspective view of a base shown in FIG. 1.

The base 10 and the cover 20 are formed by die casting metallic material, for example, aluminum alloy. Referring to FIG. 2, the base 10 comprises a base plate 11 and a pair of sidewalls 12 upwardly extending from opposite lateral sides of the base plate 11. Each sidewall 12 defines an elongated channel 121 from a rear portion 14 toward a front portion 15 of the base 10 and through a top engaging face 16 thereof. Each sidewall 12 is divided into an outer wall 122 and an inner wall 123 by the channel 121. The inner walls 123 each have a higher shoulder portion 124 adjacent to the front portion 15. The shoulder portions 124 each define a vertical gap 126 in a middle portion thereof. A pair of cylindrical posts 127 extends vertically from the base plate 11 into the gaps 126. Each inner wall 123 defines a cutout 128 adjacent to the rear portion 14. A pair of retaining blocks 129 is formed between the cutouts 128 and the rear portion 14. Each retaining block 129 defines a retaining slit 1291. The outer walls 122 each define a cutout 1221 adjacent to the front portion 15. The base plate 11 defines a pair of grooves 111 each being located between the shoulder portion 124 of a corresponding inner wall 123 and a corresponding cutout 1221. A mating frame 13 is formed at the front portion 15 of the base 10. The mating frame 13 defines an opening 133 through the front portion 15. A pair of engaging ears 131 is formed on opposite sides of a top of the mating frame 13 and extends laterally. A pair of engaging spaces 132 is defined by the front portion beside opposite lateral sides of the mating frame 13, respectively, and between the engaging ears 131 and the base plate 11. The base 10 has a first substantially semicircular opening 17 at the rear portion 14. A pair of posts 18 protrudes upwardly from the engaging face 16, located respectively beside opposite lateral sides of the first opening 17. Each post 18 defines a screw hole 181 therein and has four ribs 182 on a circumferential periphery thereof.

Figure 3:
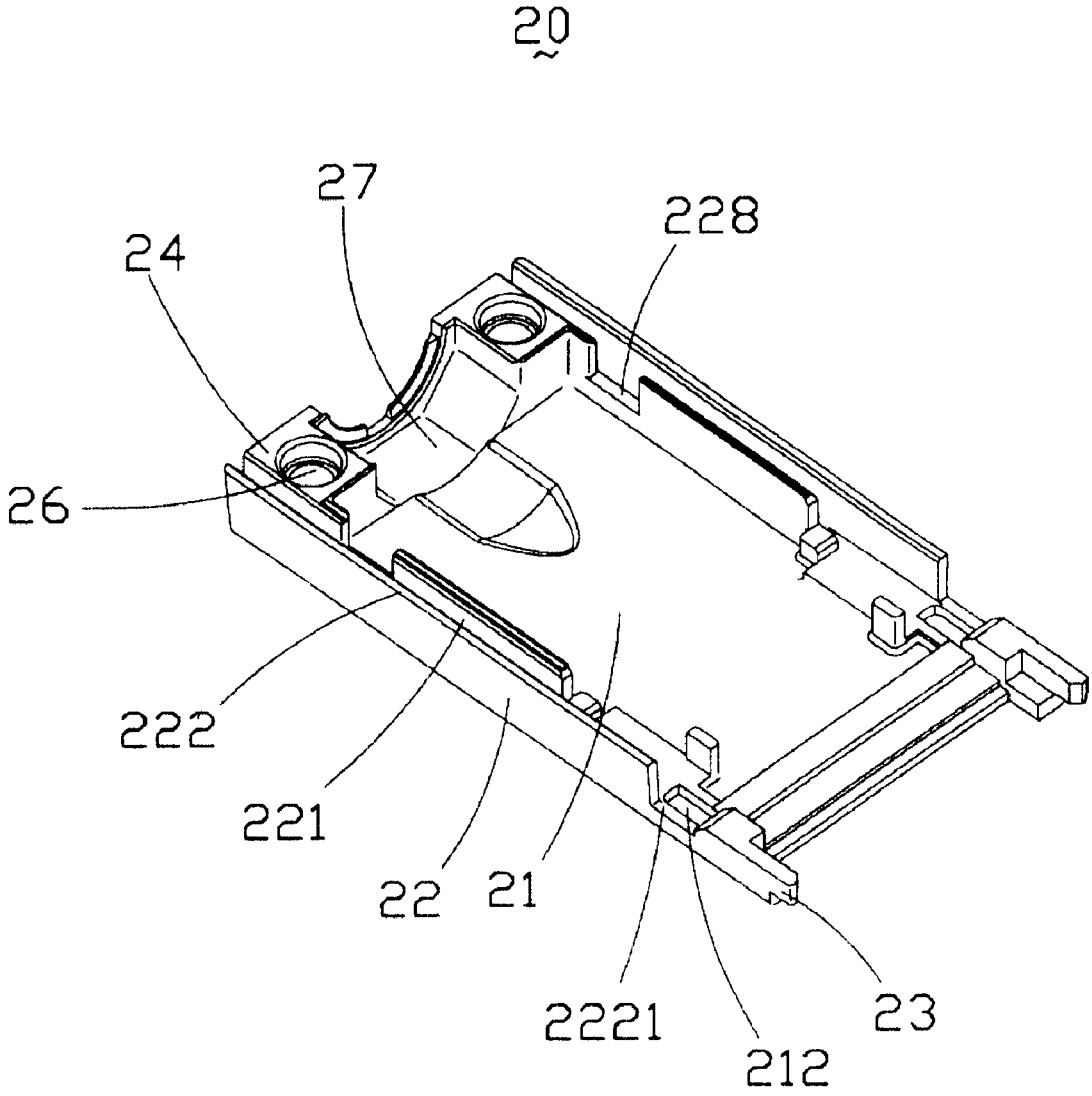
FIG. 3 is a perspective view of a cover shown in FIG. 1 from a bottom aspect.

Referring to FIG. 3, the cover 20 comprises a cover plate 21 and a pair of sidewalls 22 downwardly extending from opposite lateral sides of the cover plate 21. Each sidewall 22 defines an elongated channel 221 corresponding to one of the channels 121 of the base 10. Each sidewall 22 is divided into an outer wall 222 and an inner wall 223 by a corresponding channel 221. The inner walls 223 each defines a cutout 228 adjacent to the rear portion 24, corresponding to one of cutouts 128 of the base 10. A pair of grooves 212, corresponding to the grooves 111 in the base 10, is defined in the cover plate 21 in inner sides of a pair of cutouts 2221 which is corresponding to the cutouts 1221 of the base 10. A pair of projections 23 extends forwardly from opposite sides of a front end of the cover plate 21. A semicircular second opening 27 is defined in the rear portion 24 of the cover plate 21 corresponding to the first opening 17 of the base 10. A pair of holes 28 is defined in the rear portion 14, locating at opposite sides of the second opening 27. Each hole 28 has a diameter generally equal to an outer diameter of each of the posts 18.

Figure 4:
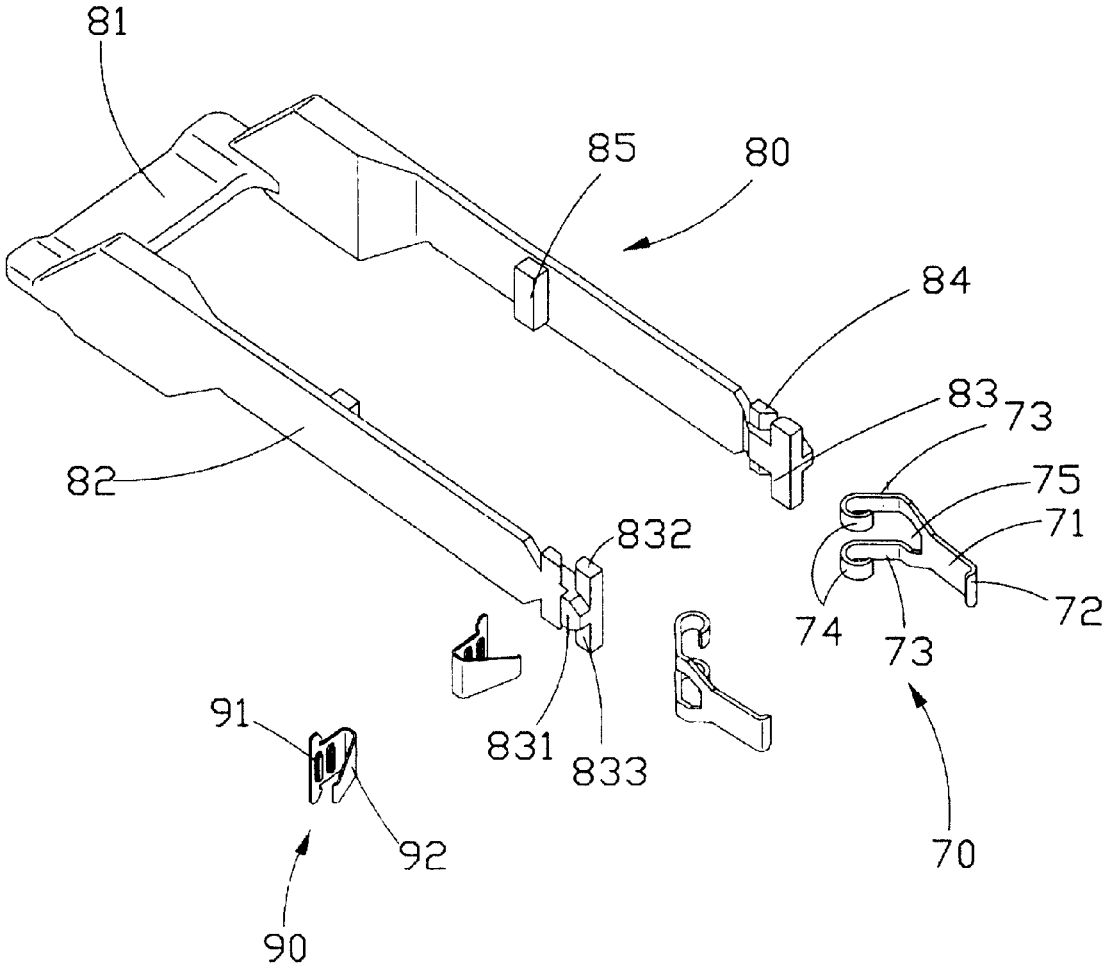
FIG. 4 is a perspective view of a pull tab, a pair of latches, and a pair of metal springs shown in FIG. 1.

Referring to FIG. 4, the metal latches 70 are formed by stamping a metal sheet. Each latch 70 comprises a body portion 71, an L-shaped claw portion 72 formed at a front end of the body portion 71, and a pair of sloping legs 73 extending inwardly from a rear end of the body portion 71. The two sloping legs 73 are spaced by a cutout 75 and each has a coiled portion 74 at a free end thereof.

The pull tab 80 comprises an operation portion 81, a pair of arms 82 extending forwardly from opposite sides of the operation portion 81, and a pair of latch releasing portion 83 formed at front ends of the arms 82, respectively. Each latch releasing portion 83 has upper and lower ends 832, 833 and a protrusion 831 protruding outwardly from an outside face thereof. The protrusion 831 is located between the upper and lower ends 832, 833. A pair of latch pushing blocks 84 is formed at rear sides of the latch releasing portions 83. Each latch pushing block 84 and latch releasing portion 83 have a space therebetween. Each arm 82 has a stopper 85 projecting from inner side thereof toward each other.

Each metal spring 90 comprises a retaining portion 91 and a spring portion 92 extending forwardly and laterally from the retaining portion 91.

Figure 5:
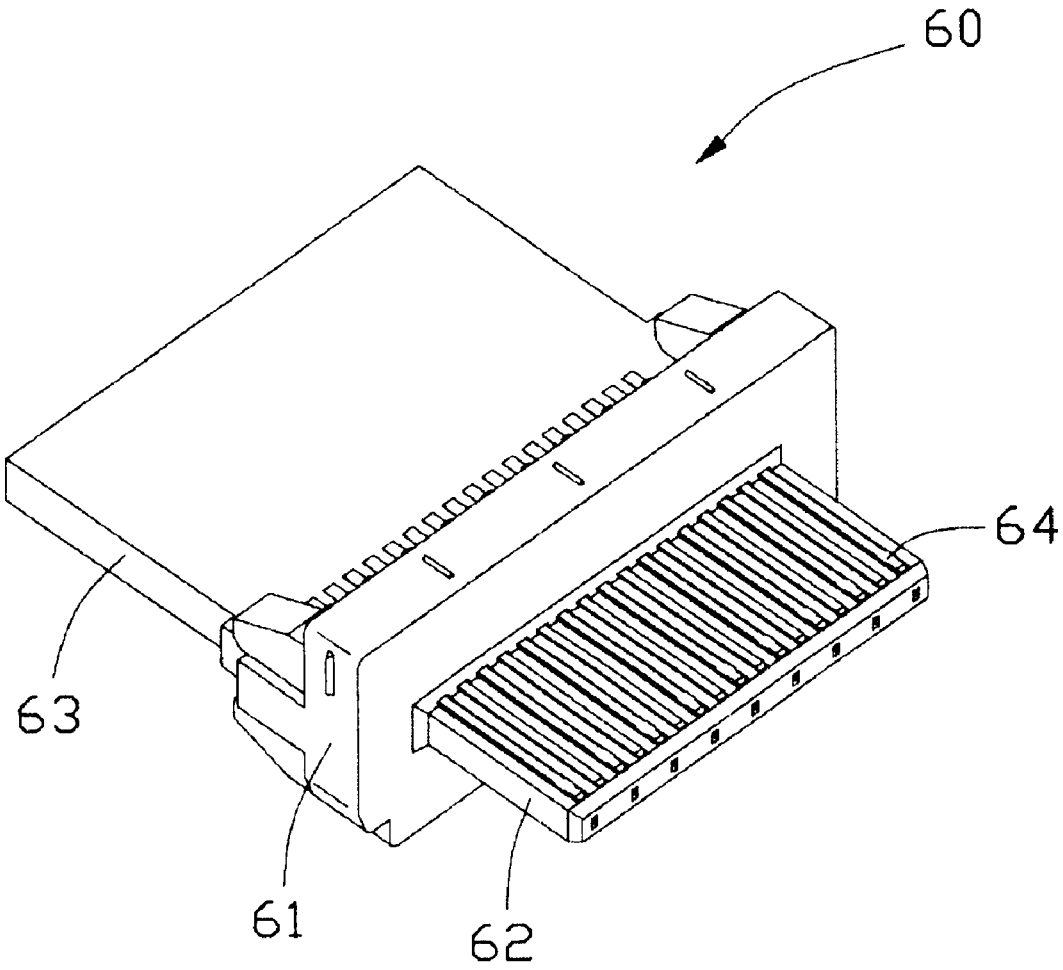
FIG. 5 is a perspective view of a connector subassembly of the electrical connector shown in FIG. 1.
Figure 6:
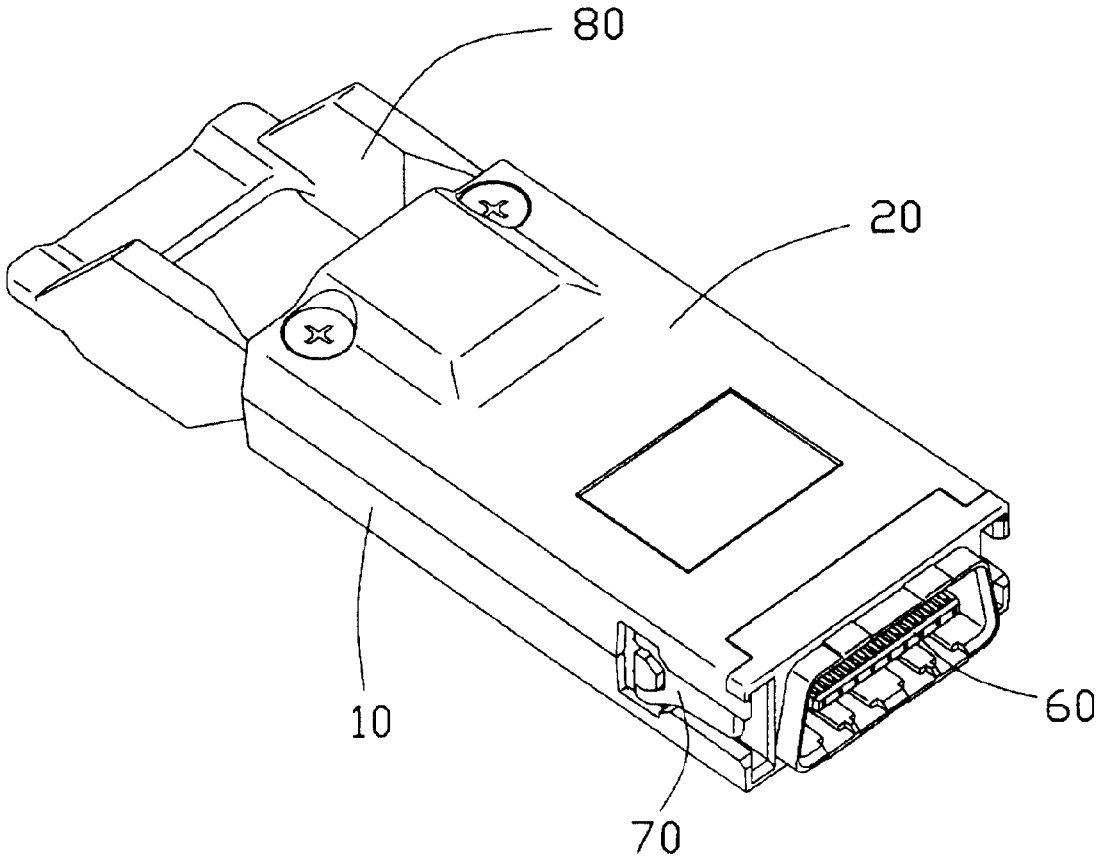
FIG. 6 is an assembled view of the electrical connector shown in FIG. 1.
Figure 7:
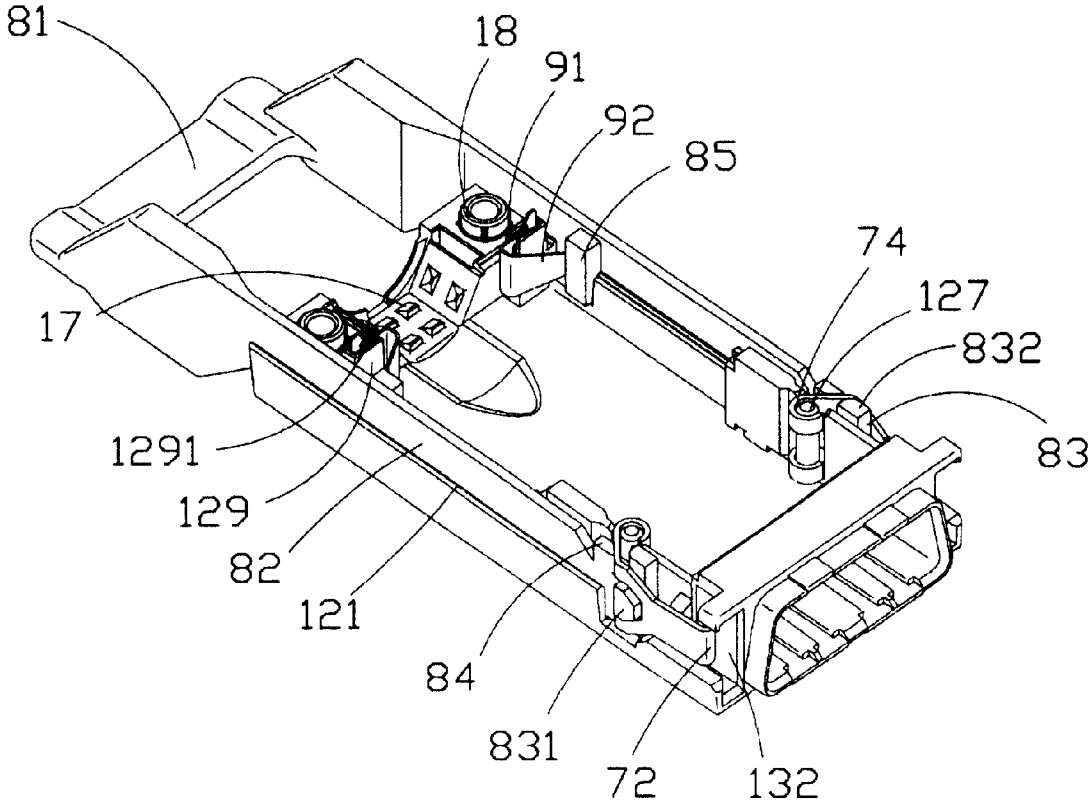
FIG. 7 is a view similar to FIG. 6 with the cover and the connector subassembly being removed.
Figure 8:
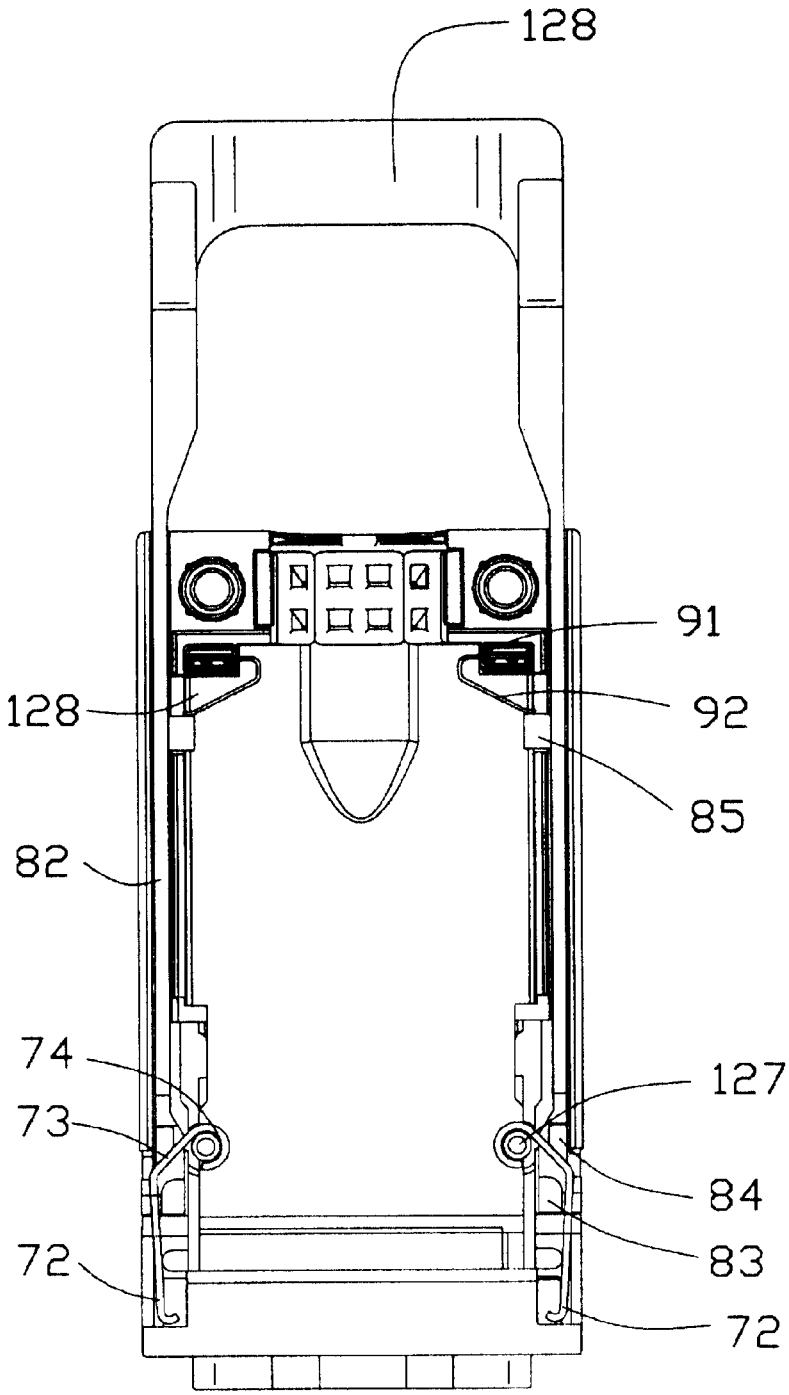
FIG. 8 is a top view of FIG. 7, with the latches in a close position.

Referring to FIG. 5, the connector subassembly 60 comprises an insulating housing 61, a tongue portion 62 extending forwardly from the housing 61, a printed circuit board (PCB) 63 assembled to the housing 61 at a rear side thereof. A plurality of contacts 64 is received in the tongue portion 62 and extends through the housing 61 to electrically connect the PCB 63.

Referring to FIGS. 6–9, in assembly, the connector subassembly 60 is assembled to the base 10 with the tongue portion 62 received in the opening 133. The PCB 63 is received in the base 10 between the two sidewalls 12. The metal springs 90 are assembled to the base 10 with the retaining portions 91 received the slits 1291 of the retaining blocks 129. The spring portions 92 extend obliquely into the cutouts 128. The two latches 70 are respectively assembled to the pull tab 80 by extending the protrusions 831 into the cutouts 75 from inner faces of the latches 70, whereby the latch releasing portions 83 engage with the inner faces of the latches 70, respectively. The latch releasing portions 83 are positioned at inner faces of the body portions 71 and the protrusions 831 are fitted into front portions of the cutouts 75. The two sloping legs 73 extend from outsides to inner sides of the latch releasing portions 83 and through the space between the latch releasing portion 83 and the latch pushing block 84. The coiled portions 74 locate at inner sides of the latch releasing portions 83. Then, the latches 70 together with the pull tab 80 are assembled to the base 10. The arms 82 are placed into the channels 121 with the operation portion 81 locating outside of the rear portion 14 of the base 10. The stoppers 85 are positioned into the cutouts 128. Tip ends of the spring portions 92 abut against rear sides of the stoppers 85. The lower ends 833 of the latch releasing portions 83 are received in the grooves 111. The coiled portions 74 ferrule the posts 127 therein. The L-shaped claw portions 72 extend into the engaging spaces 132. The cover 20 is assembled to the base 10 by placing the projections 23 beneath the pair of engaging ears 131. Then a rear portion of the cover 20 is rotated downwardly about the pair of engaging ears 131 until a bottom face of the cover 20 intimately abuts the top engaging face 16 of the base 10. Upper portions of the arms 82 are received in the channels 221, the upper ends 832 of the latch releasing portions 83 are received into the grooves 212 of the cover 20, and upper portions of the stoppers 85, the retaining blocks 129 and the metal springs 90 are received into the cutouts 228. The posts 18 are received into the holes 28 with the four ribs 182 engaging with inner surfaces of the holes 28. The first and second openings 17 and 27 together form a cable receiving opening for extension of a cable (not shown) therethrough. Finally, the screws 30 are screwed into the screw holes 181 to securely fasten the cover 20 and the base 10 together, whereby the electrical connector 1 in accordance with the present invention is obtained.

An operation of the electrical connector 1 in introduced below.

When a complementary connector (not shown) is mated with the electrical connector 1 of the present invention, the L-shaped claw portions 72 clamp corresponding engaging portions of the complementary connector. The electrical connector 1 is unmated with the complementary connector by the following operation. An operator grips the operation portion 81 of the pull tab 80 and pull it rearwards, whereby the pull tab 80 moves rearwards. The upper and lower ends 832, 833 slide rearwards in the grooves 111, 212 and the protrusions 831 slide rearwards in the cutouts 75. In the same time, the spring portions 92 of the metal springs 90 are elastically deformed rearwards by the stoppers 85. When the latch releasing portions 83 come into contact with the sloping legs 73, they exert an outward force on inner faces of the sloping legs 73. Thus, the latches 70 rotate in respect to the posts 127 and the L-shaped claw portions 72 are driven to move out of the engaging portions of the complementary connector. Accordingly, the latches 70 no longer latch with the complementary connector, and the electrical connector 1 in accordance with the present invention can be readily separated from the complementary connector.

Figure 9:
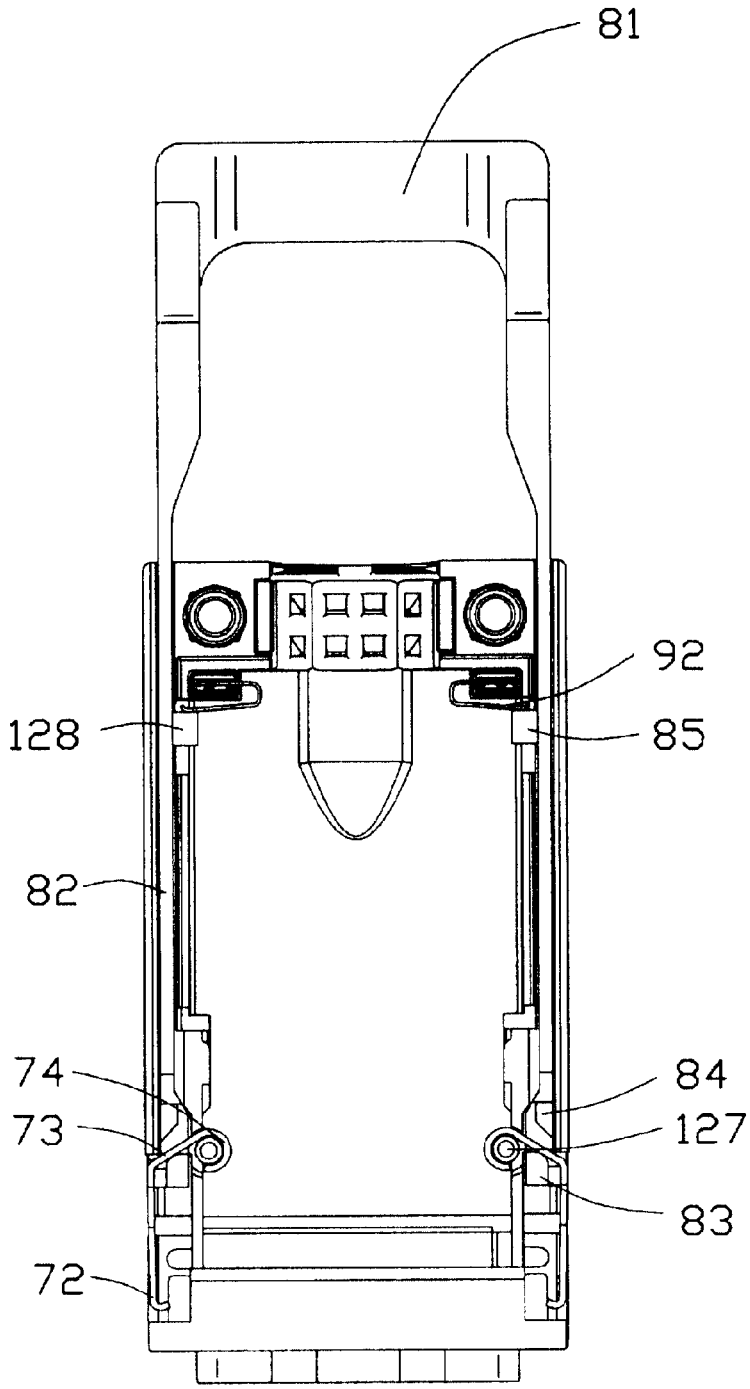
FIG. 9 is a view similar to FIG. 8, showing the latches in an open position.

When the pulling force acting on the pull tab 80 is released, a spring force generated by the deformed spring portions 92 of the metal springs 90 act on the stoppers 85 to cause the stoppers 85 and accordingly the pull tab 80 to move forwardly. The latch pushing portions 84 push sloping legs 73 to cause the latches 70 to rotate in respect to the posts 127 in a reverse direction. Thus, the latches 70 and the pull tab 80 revert to the original positions as shown in FIG. 9.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a base having a mating frame formed on a front portion thereof and biasing means assembled thereto;

a connector subassembly assembled to the base and having a portion extending into the mating frame and having a plurality of terminals received therein;

a pair of latches mounted to opposite sides of the base and being deflectable in lateral direction;

a pull tab assembled to the base and having a pair of latch releasing portions, the pull tab being movable in front-to-back direction which is perpendicular to the lateral direction; and a cover assembled to the base;

wherein when the pull tab is pulled backwardly, the latch releasing portions push the latches to laterally deflect and the biasing means is elastically deformed and when the pull tab is released, the biasing means exerts a spring force on the pull tab to cancel the pull tab and the latches to return back to original positions wherein the pull tab has an operation portion and a pair of arms extending from a pair of ends of the operation portion, the latch releasing portions are formed at free ends of the arms, a pair of stoppers is protruded from inner sides of the arms, the stoppers abut against the biasing means comprising a pair of metal springs, when the pull tab moves backwardly, the metal springs are elastically deformed by the pair of stoppers.

2. The electrical connector assembly as described in claim 1, wherein the base defines a pair of elongated first channels on opposite sides thereof, the pair of arms are respectively received in the first channels and the operation portion locates outside the base and the cover.

3. The electrical connector assembly as described in claim 1, wherein each metal spring comprises a retaining portion assembled to the base and a spring portion extending from the retaining portion to abut against the stoppers of the pull tab.

4. The electrical connector assembly as described in claim 3, wherein the base defines a pair of slits to receive the retaining portions of the metal springs therein.

5. The electrical connector assembly as described in claim 1, wherein each latch comprises a body portion, a claw portion formed at a front end of the body portion, and a pair of sloping legs extending inwardly from rear end of the body portion, the sloping legs are spaced by a cutout and each has a coiled portion at a free end thereof.

6. The electrical connector assembly as described in claim 5, wherein the base has a pair of cylindrical posts formed near the front portion, the coiled portions of the latches enclose the posts therein.

7. The electrical connector assembly as described in claim 6, wherein the pull tab has a pair of latch pushing blocks formed at rear sides of the latch releasing portions, when the pull tab is pulled, the latches rotate in respect to the posts, after the pull tab is released, the latch pushing blocks push the latches to original positions.

8. The electrical connector assembly as described in claim 2, wherein the cover defines a pair of elongated second channels on opposite sides thereof corresponding to the first channels of the base, upper portions of the arms of the pull tab are received in the second channels.

9. An electrical connector assembly comprising:

a base having a mating frame formed on a front portion thereof, a pair of cylindrical posts extending upwardly from the base near the front portion;

a connector subassembly assembled to the base and having a portion extending into the mating frame and having a plurality of terminals received therein;

a cover assembled to the base;

a pull tab mounted on the base and having a pair of latch releasing portions, the pull tab being movable in front-to-back direction;

a pair of latches each having a body portion, a claw portion formed at a front end of the body portion, and a pair of sloping legs extending inwardly from rear end of the body portion, the sloping legs each having a coiled portion at a free end thereof, the coiled portions enclosing a corresponding post posts of the base therein, when the pull tab is pulled backwardly, the latch releasing portion pushing the latches to rotate in respect to the posts of the base wherein the pull tab has an operation portion and a pair of arms extending from a pair of ends of the operation portion, the latch releasing portions are formed at free ends of the arms, a pair of stoppers protruding from inner sides of the arms, wherein the base defines a pair of slits and a pair of metal springs received therein, each metal spring has a spring portion abutting against the stopper of the pull tab, when the pull tab is pulled, the metal springs are elastically deformed by the stoppers, wherein the pull tab has a pair of latch pushing blocks formed at rear sides of the latch releasing portions, after the pull tab is released, the pull tab moves forwardly by the metal springs and the latch pushing blocks push the latches to original positions.

* * * * *